United States Patent [19]

Nakamura

[11] Patent Number: 4,941,008

[45] Date of Patent: Jul. 10, 1990

[54] PHOTOSENSITIVE MATERIAL PROCESSING APPARATUS

[75] Inventor: Takashi Nakamura, Minami-ashigara, Japan

[73] Assignee: Fuji Photo Film Co., Ltd., Kanagawa, Japan

[21] Appl. No.: 367,088

[22] Filed: Jun. 16, 1989

[30] Foreign Application Priority Data

Jun. 17, 1988 [JP] Japan ..... 63-150883
Jul. 22, 1988 [JP] Japan ..... 63-183777

[51] Int. Cl.[5] ..... G03D 3/02
[52] U.S. Cl. ..... 354/320; 354/324
[58] Field of Search ..... 354/319, 320, 321, 322, 354/323, 324, 331, 305

[56] References Cited

U.S. PATENT DOCUMENTS 3,662,660 5/1972 Layne ..... 354/320
4,023,190 5/1977 Fassler ..... 354/324
4,187,023 2/1980 Schausberger et al. ..... 354/324
4,324,479 4/1982 Sachs ..... 354/324
4,616,915 10/1986 Norris ..... 354/331

*Primary Examiner*—A. A. Mathews
*Attorney, Agent, or Firm*—Sughrue, Mion, Zinn, Macpeak & Seas

[57] ABSTRACT

An apparatus for processing a web or sheet of photosensitive material by passing it through a processing tank is provided. The apparatus includes a processing tank of the closed type having an inlet slit and an outlet slit for the photosensitive sheet. The tank is filled with processing solution and replenished with solution from an external supply. Each of the inlet and outlet slits has such a small opening that the processing solution may not leak through the slit due to its surface tension. The photosensitive sheet is carried into the tank via the inlet, through the tank along a predetermined path, and then out of the tank via the outlet by means of rollers or other conveyors.

2 Claims, 6 Drawing Sheets

PHOTOSENSITIVE MATERIAL PROCESSING APPARATUS

This invention relates to a photosensitive material processing apparatus and more particularly, to an apparatus for processing photosensitive material for wet development or bleach-fixation.

BACKGROUND OF THE INVENTION

A variety of apparatus are known for the wet development of photosensitive material They are generally designed such that photosensitive material is carried into a processing tank filled with processing solution, more specifically developing solution The photosensitive material is developed while it is immersed in the solution for a predetermined time. It is often desired to continuously develop webs or sheets of photosensitive material with such processing apparatus. The tank is often of the open type which keeps the surface of processing solution open to the ambient. Upon contact with air, the processing solution not only evaporates, but also undergoes a temperature lowering as well as deterioration and changes of properties such as oxidation by taking in oxygen from air and a pH lowering by taking in carbon dioxide from air.

Many problems arise from evaporation of the processing solution. Evaporation would create a difference in concentration of the processing solution between the top and the bottom of the tank, adversely affecting uniform development. An extra volume of processing solution must be replenished since the processing solution decreases its volume rather quickly. In addition, vapor of processing solution will deposit on nearby parts of the processing apparatus, particularly on rollers for conveying photosensitive material and dry to a tacky-dry state, causing sticking and stains.

It is apparent that deterioration and property changes of the processing solution adversely affect development.

For optimum development, the processing solution should be maintained at an appropriate temperature in the range of 20° to 60° C. A larger amount of heating energy is necessary to maintain the solution at the temperature if a larger amount of heat dissipates from the solution surface.

When the photosensitive material processing apparatus having an open top processing tank is applied to a processing section of a silver salt photographic copying machine, selection of installation conditions and a photosensitive material transfer path is limited. More particularly, the processing tank must be placed with its open top faced vertically upward so as to prevent the solution from spilling. It is necessary to carry photosensitive material into and out of the processing tank through its open top portion. Consequently, the path along which the photosensitive material is passed through the tank is limited to some patterns The design of the processing tank must be made within a limited range of freedom in consideration of proper orientation. Also a relatively large space is necessary for installation of the tank and accessories, resulting in a larger size of apparatus.

These problems are aggravated when a plurality of tanks are arranged in juxtaposition. Such is often the case in an automatic photosensitive material processing apparatus in which a series of tanks are arranged for development, bleach-fixation, and washing and an exposed photosensitive material is passed through the successive tanks for development.

SUMMARY OF THE INVENTION

An object of the present invention is to eliminate the above-mentioned drawbacks and to provide a novel and improved photosensitive material processing apparatus.

Another object of the present invention is to provide a photosensitive material processing apparatus which can prevent the processing solution from evaporating, lowering its temperature, deteriorating, and changing its properties.

A further object of the present invention is to provide a photosensitive material processing apparatus which offers a wide range of choice for installation and photosensitive material travel path.

We have found that a processing tank of the closed or non-open type is effective to achieve the objects. The closed type used herein means that the tank has no opening except an inlet and an outlet through which photosensitive material is carried into and out of the tank.

According to the present invention, there is provided a photosensitive material processing apparatus comprising a processing tank of the closed type having an inlet and an outlet for photosensitive material, the tank being filled with processing solution, transfer means for carrying the photosensitive material into the tank through the inlet, along a predetermined path in the tank, and then out of the tank through the outlet, and supply means for supplying processing solution to the tank. Each of the inlet and the outlet is in the form of a slit having such a small opening that the processing solution may not leak through the slit due to its surface tension.

In a preferred embodiment, seal means is disposed adjacent the inlet slit and/or the outlet slit for providing a fluid-tight seal to the slit, but allowing passage of the photosensitive material.

Preferably, the supply means supplies a controlled amount of processing solution to the tank to maintain the solution in the tank at a predetermined pressure.

BRIEF DESCRIPTION OF THE DRAWINGS

The above and other objects, features, and advantages of the present invention will be better understood from the following description taken in conjunction with the accompanying drawings, in which.

Throughout the figures, like parts are designated by like reference numerals.

DESCRIPTION OF THE PREFERRED EMBODIMENTS

The photosensitive material processing apparatus adapted for carrying out development or bleach-fixation of photosensitive material is described for five preferred embodiments by referring to the figures. It will be understood that the photosensitive material processing apparatus of the present invention is not limited to these embodiments with respect to its application and organization.

First Embodiment

Figure 1:
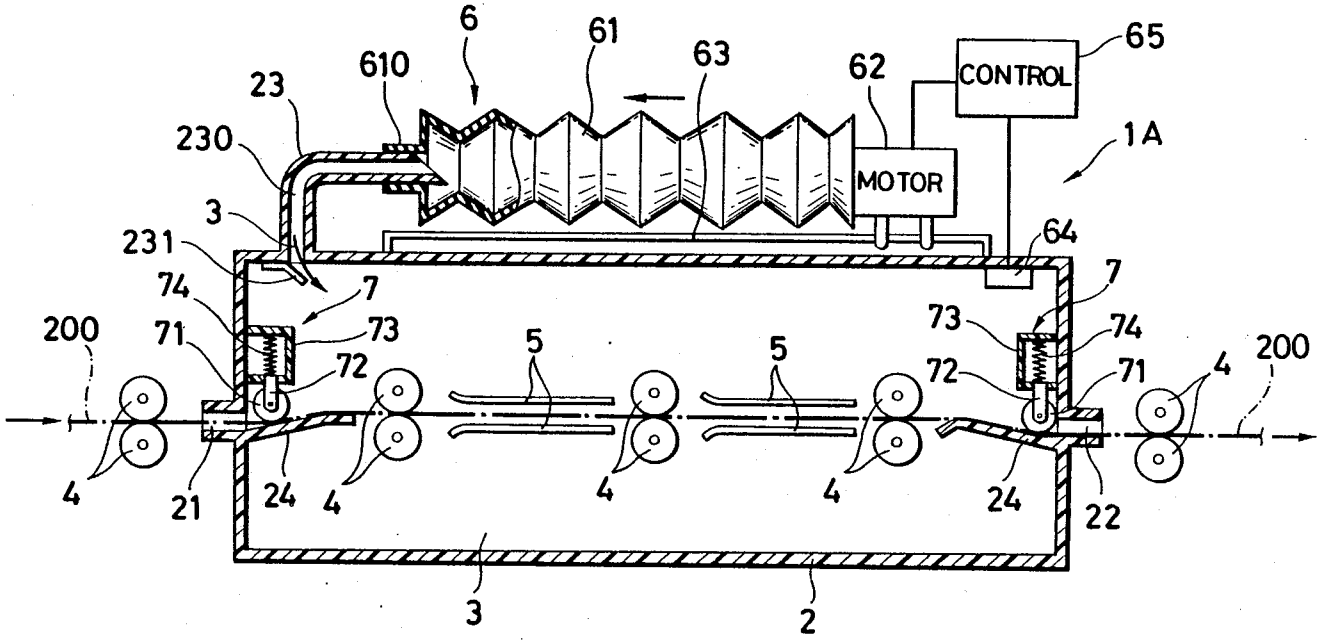
FIGS. 1, 2, 3, 5, and 6 are schematic cross sections of photosensitive material processing apparatus according to different embodiments of the present invention.

FIG. 1 is a schematic cross section of photosensitive material processing apparatus according to a first embodiment of the present invention.

The apparatus generally designated at 1A includes a processing tank 2 of the closed type filled with a processing solution 3, transfer means in the form of conveyor rollers 4 for carrying a web or sheet of photosensitive material 200, supply means 6 for supplying a processing solution to the tank, and seal means 7.

For the purpose of description, the term longitudinal direction represents a direction from the left to the right or vice versa as viewed in FIGS. 1–6 and the transverse direction is perpendicualr to the plane of the figures. A web or sheet of photosensitive material is passed in a longitudinal direction in most cases, and the transverse direction corresponds to the width direction of the photosensitive sheet or perpendicular to the direction of its travel.

The processing tank 2 is a rectangular vessel having a volume appropriate for processing of the photosensitive material and filled with processing solution 3. The type of processing solution depends on a particular application of apparatus 1A. The processing solution may be a developing solution, a blix solution or a wash liquid when the apparatus is used for development, bleach-fixation or washing of photosensitive material. Of course, the type of processing solution which can be used herein is not limited to these examples.

The processing solution 3 is often heated to a temperature of about 20° to about 60° C. as previously described. The processing tank 2 may be enclosed in an insulator (not shown) for enhanced thermal insulation of the processing solution.

The processing tank 2 at its longitudinally opposed sides is provided with an inlet 21 and an outlet 22 through which the photosensitive material is carried into and out of the tank. The processing tank 2 has no part in communication with the ambient atmosphere except inlet 21 and outlet 22. That is, the tank has no openings through which processing solution 3 can seek escape to the exterior, except inlet 21 and outlet 22. The tank 2 is of closed type in this sense.

The processing tank 2 at its top wall is provided with a supply conduit 23 for supplying processing solution into the tank. The supply conduit 23 is connected to the solution supply means 6 which will be described later.

Disposed in processing tank 2 are three pairs of conveyor rollers 4. A pair of guide plates 5 intervene between the adjacent pairs of rollers 4. Pairs of front and rear conveyor rollers 4 are respectively disposed forward and rearward of tank inlet 21 and outlet 22. These rollers 4 and guide plates 5 constitute the transfer means, with those rollers 4 and guide plates 5 in the tank defining a linear path (shown in phantom) for photosensitive material in substantial alignment with inlet 21 and outlet 22. The photosensitive material 200 is clamped by the pair of front rollers 4 (left in FIG. 1), then carried into processing tank 2 through inlet 21, advanced along the path between rollers 4 and guide plates 5, carried out of the tank through outlet 22, clamped by the pair of rear rollers 4, and then fed to a subsequent station as shown by arrows. While the photosensitive material is passed through the tank in this way, it is kept in contact with the solution for processing.

The inlet 21 and outlet 22 are slits which allow the web or sheet of photosensitive material 200 to pass therethrough. The slit has an elongated rectangular cross section. The slit has such a small opening that the processing solution may not leak through the slit due to its surface tension, provided that the solution in the tank is under a predetermined pressure, most often under approximately atmospheric pressure. The opening of inlet and outlet slits 21 and 22 may be determined though experimentation as a function of the surface tension of solution. Typical openings for some processing solutions are shown in Table 1. In Table 1, the opening of a slit is given as the maximum permissible slit width for processing solution under a pressure of 1.00 atmosphere.

TABLE 1

| Type of processing solution | Surface tension (dyne/cm$^2$) | Maximum slit width (mm) |
|---|---|---|
| Color developing solution | 35–40 | 1.5 |
| Blix solution | 35–40 | 1.5 |
| Stabilizing solution | 25–30 | 1.5 |
| Wash liquid | 50–60 | 2.5 |

The slit width is the vertical distance of inlet and outlet slits 21 and 22 as viewed in FIG. 1. Although the opening of inlet and outlet slits 21 and 22 is represented by the slit width, the opening may be represented by any other factors, for example, the ratio of the open area of inlet and outlet slits 21 and 22 to the volume of processing tank 2.

The seal means 7 are disposed in processing tank 2 adjacent inlet 21 and outlet 22. The entrance and exit seal means are of the same structure. Each seal means 7 includes a roller 71 capable of providing a fluid-tight seal to the inlet or outlet slit from inside the tank. A ramp 24 extends from the inner wall of processing tank 2 in register with the lower edge of the inlet or outlet slit toward the interior of tank 2. The roller 71 is pivoted for rotation at one end of an arm 72 which is received in a fitting 73 affixed to the inner wall of processing tank 2. A spring 74 is received in fitting 73 and connected to the other end of arm 72 to bias roller 71 to ramp 24. Thus roller 71 is normally biased in close contact with the tank inner wall and ramp 24, thereby shielding inlet 21 or outlet 22 from the inside.

In carrying the web or sheet of photosensitive material 200, the incoming web or sheet itself puts away roller 71 (upward in FIG. 1) against biasing forces of spring 74 finding a way between roller 71 and ramp 24.

The material of which rollers 71 are made is not critical although materials capable of close contact with the tank inner wall and ramp 24 are preferred. To this end, rollers 71 may be made of the same elastomeric materials as will be later described for squeezers 81, 82 or made of a rigid material and coated with such elastomeric material on the cylindrical surface.

Provision of seal means 7 ensures to prevent the processing solution from leaking through inlet 21 and outlet 22. Positive prevention of solution leakage is advantageous particularly when the photosensitive material processing apparatus undergoes vibration as in transporting the apparatus by a vehicle without emptying the apparatus of solution.

It is contemplated to place the seal means 7 outside the processing tank 2 adjacent inlet 21 and outlet 22. It is also contemplated to provide single seal means 7 at either inlet 21 or outlet 22. The provision of seal means is not essential to the present invention.

The supply means 6 includes the supply conduit 23 in communication with tank 2 at one end designated as a supply port 230 and with a reservoir 61 at the other end. The supply means 6 supplies processing solution from reservoir 61 to tank 2 through conduit 23. As the photosensitive material is continuously processed, the amount of processing solution in tank 2 is gradually reduced by drag-out. Thus supply means 6 replenishes processing solution in an amount corresponding to the drag-out while preventing air from entering tank 2 through inlet 21 and outlet 22.

The supply conduit 23 is provided at supply port 230 with a check valve 231 for preventing the processing solution 3 from flowing back to reservoir 61. This is because the processing solution in tank 2 is more or less exhausted with the progress of processing. The replenisher solution in reservoir 61 can be maintained fresh by preventing back-flow of the once used solution from tank 2 to reservoir 61.

The supply means 6 includes the reservoir 61 in the form of a collapsible bellows bottle having an open mouth 610 and a closed bottom. The conduit 23 is removably connected to mouth 610 of reservoir 61 to communicate the interior of reservoir 61 to supply port 230.

When reservoir 61 is emptied of solution, it is removed by disconnecting its mouth 610 from conduit 23 and instead, another reservoir full of fresh processing solution is connected to conduit 23. To prevent air entry into tank 2 through supply port 230 upon replacement of the reservoir, the conduit 23 is preferably provided at an intermediate with valve means for selectively closing supply port 230 (not shown). One preferred example of the valve means is an electromagnetic valve disposed at an intermediate of conduit 23. A provision is made to actuate the electromagnetic valve to plug the conduit path when reservoir 61 is contracted to the maximum, thereby preventing air entry into tank 2 upon replacement of the reservoir. Instead of the electromagnetic valve, a manual valve or cock may be used at an intermediate of conduit 23.

A step motor 62 is disposed in abutment with the bottom of reservoir 61. The step motor 62 is supported for longitudinal motion on a rail 63 which extends parallel to the top wall of processing tank 2. As the motor 62 is moved stepwise to the left in FIG. 1, the reservoir 61 is contracted to force the processing solution out of the reservoir to tank 2 through conduit 230.

It is desirable to control the amount of processing solution fed to tank 2 so as to maintain the processing solution in the tank at a predetermined pressure. To this end, processing tank 2 is provided with a pressure detector 64 for detecting the pressure in the tank, for example, in the form of a pressure sensor utilizing a rubber diaphragm. The detector 64 is electrically connected to a control unit 65 in the form of a micro-computer, which is electrically connected to motor 62. Then the detector detects the pressure of processing solution in the tank and transmits such pressure information to control unit 65 where the pressure information is computed to determine the distance of motor 62 to be moved. The control unit 65 produces a command signal to motor 62 causing motor 62 to advance the necessary distance.

Although the controllable solution supply means is described as far, the control system including step motor 62, rail 63, pressure detector 64, and control unit 65 may be omitted or modified. It is contemplated in the present invention to use a more simple solution supply means which includes only a reservoir similar to the above-mentioned reservoir 61 or another collapsible reservoir and the conduit 23. In this embodiment, connection is made such that the pressure in reservoir 61 lowers as the pressure in tank 2 lowers. Then reservoir 61 automatically contracts under the atmospheric pressure, causing the processing solution in reservoir 61 to flow into processing tank 2 which restores the predetermined pressure. It is thus preferred to form reservoir 61 from a flexible material or imparting internal shrinkage stresses to reservoir 61.

The solution supply means 6 is not limited to the above-mentioned structures. Any desired solution supply mechanisms may be used insofar as they can supply processing solution to tank 2 as desired. For example, a reservoir filled with processing solution may be connected to inlet port 230 of tank 2 through a conduit which has a pump and a pressure regulating valve mounted therein. Then the pump can feed the solution to the tank. It is preferable to use a pressure regulating valve which operates in response to the internal pressure of tank 2. In this case, the reservoir need not be collapsible.

The photosensitive material processing apparatus 1A operates as follows.

A web or sheet of photosensitive material 200 is delivered to the apparatus from the left in FIG. 1. It is clamped between front conveyor rollers 4, 4 and carried into processing tank 2 through inlet slit 21. The leading edge of the photosensitive sheet comes in abutment with roller 71, pushes the roller vertically away, and advances forward between roller 71 and ramp 24.

After entering tank 2, the photosensitive sheet 200 is carried through the tank along the path defined by three pairs of rollers 4 and two pairs of guide plates 5. It is processed with the solution during passage through the tank.

On approaching outlet 22, the photosensitive sheet 200 advances past the seal means 7 by passing between roller 71 and ramp 24 in a similar manner as above. It is carried out of the tank through outlet slit 22 and clamped between the pair of rear rollers 4 for delivery to a subsequent station.

According to the invention, inlet and outlet slits 21 and 22 of processing tank 2 are set to such an opening that the surface tension of processing solution prevents the solution from leaking out of the tank therethrough under the predetermined pressure. Thus leakage of processing solution through inlet and outlet slits 21 and 22 does not occur regardless of whether or not the photosensitive sheet 200 is being carried into and out of the tank.

Since inlet and outlet slits 21 and 22 are shut off inside processing tank 2 by rollers 71 of seal means 7, leakage of processing solution through inlet and outlet slits 21 and 22 does not occur even when vibration is applied to apparatus 1A.

As the photosensitive material 200 is processed continuously or in increments, the volume of processing solution in tank 2 is gradually reduced due to drag-out of the processing solution being entrained on the surface of photosensitive material. A reduction of processing solution volume in the tank causes the pressure in the tank to lower because the tank is of closed type. The pressure sensor 64 in tank 2 detects such a pressure drop and supplies a detection signal to control unit 65. The control unit 65 computes the input indicative of pressure information to calculate the distance over which step motor 62 is to be moved. Upon receipt of a command signal from control unit 65, step motor 62 moves forward (to the left in FIG. 1) the calculated distance.

Motion of step motor 62 to the left in FIG. 1 over the calculated distance causes reservoir 61 to contract for forcing the processing solution out of reservoir 61 to tank 2 through conduit 23. The processing solution in the tank restores the predetermined pressure. In this way, a controlled amount of processing solution is replenished to tank 2 such that the predetermined pressure may be maintained in the tank.

When reservoir 61 becomes empty, it is replaced with a new reservoir full of processing solution as previously described.

It is also contemplated to serially arrange a plurality of processing tanks 2 which are filled with different processing solutions, for example, developing, blix, and wash solutions whereby photosensitive material is successively carried through the tanks for different processing purposes. In this embodiment, the photosensitive material can be passed straight forward through the serially arranged tanks without changing its direction. Thus this embodiment eliminates the need for turning members such as crossover rollers 10 and reversal guides 11 as will be later described in the fifth embodiment shown in FIG. 6.

Second Embodiment

Figure 2:
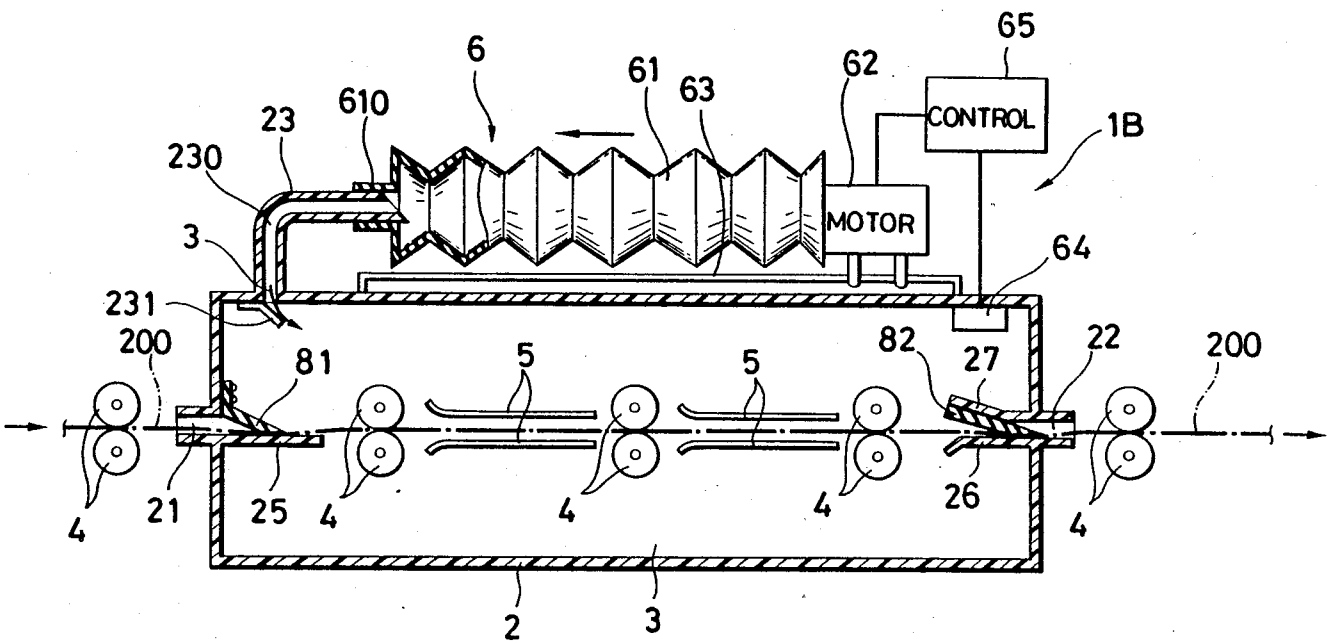

FIG. 2 is a schematic cross section of photosensitive material processing apparatus according to a second embodiment of the present invention.

Regarding the construction and operation of the photosensitive material processing apparatus 1B shown in FIG. 2, the following description is made of only its difference from apparatus 1A of FIG. 1. The remaining construction and operation are substantially the same as in apparatus 1A of FIG. 1.

The photosensitive material processing apparatus 1B is different from apparatus 1A in the construction of seal means. An extension 25 longitudinally extends from the inner wall of processing tank 2 in register with the lower edge of inlet slit 21 toward the interior of the tank. A squeezer 81 of elastomeric material is affixed to the inner wall of processing tank 2 adjacent the upper edge of inlet slit 21. The squeezer 81 extends obliquely downward such that the distal or free end of squeezer 81 engages extension 25.

Similarly, an extension 26 longitudinally extends from the inner wall of processing tank 2 in register with the lower edge of outlet slit 22 toward the interior of the tank. A longitudinally extending support 27 is affixed to the inner wall of processing tank 2 adjacent the upper edge of outlet slit 22. A squeezer 82 of elastomeric material is affixed to the inner end of support 27 and extends obliquely downward toward outlet slit 22 such that the distal or free end of squeezer 82 engages extension 26.

During quiescent periods when no photosensitive material is carried in, the distal or free ends of squeezers 81 and 82 are in close contact with extensions 25 and 26, closing inlet and outlet slits 21 and 22. When the photosensitive material is carried in, it pushes away the free ends of squeezers 81, 82 so that it passes between squeezers 81, 82 and extensions 25, 26.

The squeezers 81 and 82 may be formed of elastomeric materials including various rubbers and flexible resins. Preferred examples include rubbers such as neoprene rubber, silicone rubber and urethane rubber as well as flexible resins such as polyethylene, polypropylene, silicone resins, fluorocarbon resins as typified by Teflon (E. I. duPont), and polyesters as typified by Tetoron (Toray K. K.). They are selected from the aspect that the elastomeric materials should be chemically resistant (do not expand, distort, deform, crack or weaken in contact with the processing solution) and not be dissolved into the processing solution to adversely affect its properties.

The squeezers 81 and 82 may be provided outside the processing tank adjacent inlet 21 and outlet 22.

Third Embodiment

Figure 3:
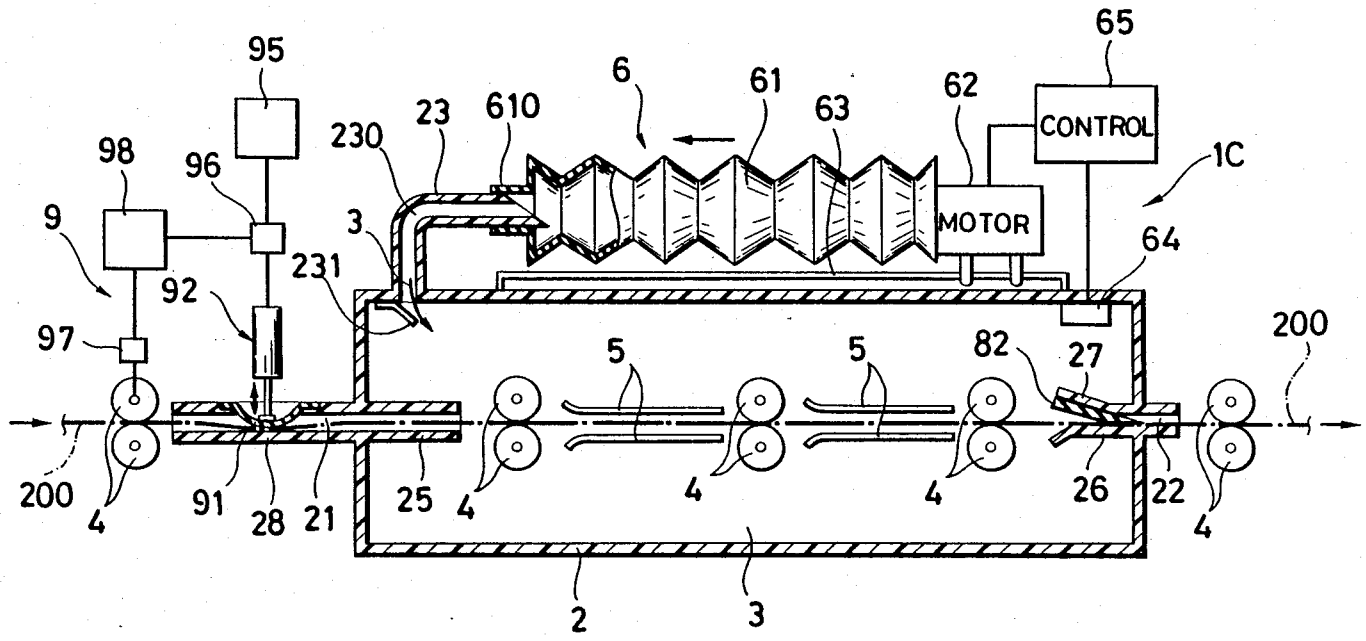

FIG. 3 is a schematic cross section of photosensitive material processing apparatus according to a third embodiment of the present invention.

Regarding the construction and operation of the photosensitive material processing apparatus 1C shown in FIG. 3, the following description is made of only its difference from apparatus 1A and 1B of FIGS. 1 and 2. The remaining construction and operation are substantially the same as in apparatus 1A and 1B.

The photosensitive material processing apparatus 1C is different from apparatus 1B in the construction of inlet seal means.

As opposed to the seal means used in apparatus 1A and 1B which are designed such that the advancing photosensitive material 200 itself pushes away the rollers 71 or squeezers 81, 82 to open its pathway as previously described, apparatus 1C uses positive seal means 9 adapted to controlledly open or close the inlet slit 21 by means of a separate drive.

Figure 4:
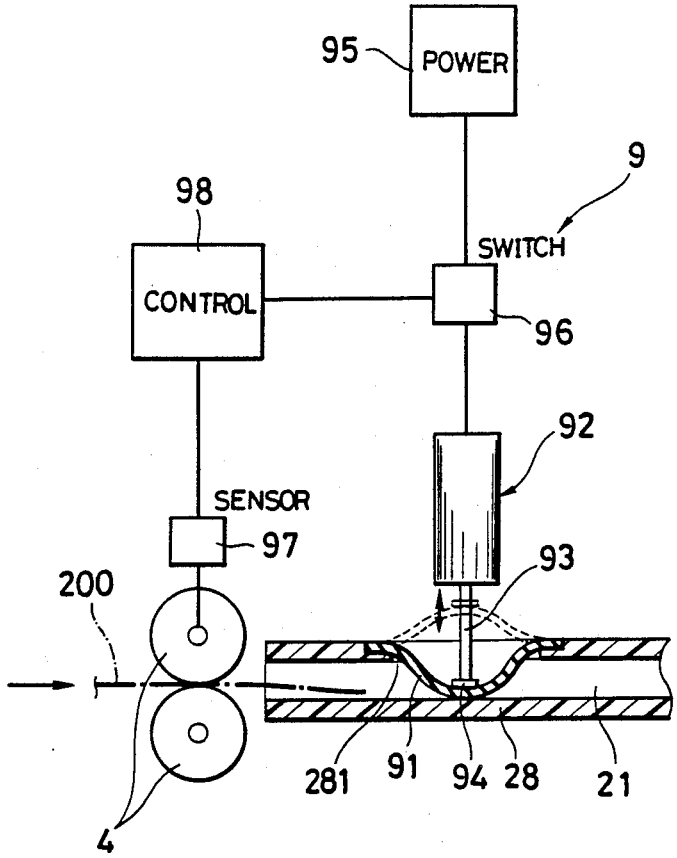
FIG. 4 is an enlarged illustration of the seal means used in the photosensitive material processing apparatus of FIG. 3.

FIG. 4 illustrates in an enlarged scale seal means 9 used in apparatus 1C of FIG. 3.

In this embodiment, the inlet slit 21 is defined by a generally rectangular extended sleeve 28 having upper and lower planar walls. The sleeve upper wall is provided with an elongated aperture 281. It will be understood that aperture 281 extends transversely or perpendicular to the plane of the figure. A diaphragm 91 which covers aperture 281 is attached to the aperture periphery. The diaphragm 91 is in the form of a flexible sheet or film and may be made of elastomeric materials including rubbers and flexible resins, preferably those materials exemplified for the squeezers 81, 82. A pair of conveyor rollers 4 are disposed in front of the inlet defining sleeve 28 in registry relationship.

Disposed above aperture 281 is a drive in the form of a solenoid 92 having a vertically extending plunger 93. A transversely extending rigid member in the form of a bar 94 is secured to diaphragm 91 at an intermediate. The distal end of plunger 93 is affixed to bar 94. The solenoid 92 is electrically connected to a power supply 95 through a switch 96.

Means for detecting the presence or absence of photosensitive material is provided in the path. For example, a sensor 97 is provided in association with one of rollers 4 for detecting its rotation. A control unit 98 having a micro-computer built therein is electrically connected to sensor 97 and switch 96.

It will be understood that the sensor 97 may be of any desired designs including a sensor for physically detecting rotation of roller 4, a sensor for electrically detecting actuation of a motor for driving roller 4, and a sensor (typically optical) for detecting the photosensitive material 200 approaching inlet 21. The solenoid 92 may be a well-known one insofar as its plunger 93 is extended and retracted over a predetermined stroke by electrical actuation.

The seal means 9 of the above-mentioned construction operates as follows.

In an operating period, sensor 97 detects the arrival of the photosensitive material 200 (approaching inlet 21). In response to the detection signal, control unit 98 turns on switch 96 to energize solenoid 92. Actuation of solenoid 92 causes plunger 93 to retract, pulling diaphragm 91 to the upper position shown by broken lines in FIG. 4 for opening a narrow passage within sleeve 28, that is, opening inlet 21. This allows the photosensitive material 200 to pass through inlet 21.

In a quiescent period when no photosensitive material is carried in, sensor 97 produces a signal indicative of the absence of photosensitive material. In response to the absence signal, control unit 98 turns off switch 96 to deenergize solenoid 92. Then plunger 93 is extended to urge diaphragm 91 to the lower position shown by solid lines in FIG. 4. The thus deformed diaphragm 91 at its apex is held in close contact with the lower wall of sleeve 28, closing inlet 21. The diaphragm 91 blocks inlet 21 in a substantially liquid tight manner to prevent any leakage of processing solution through inlet 21 even when the tank vibrates for some reason.

Although seal means 9 is provided only on the side of inlet 21 for carrying in the photosensitive material in the embodiment of FIG. 3, the seal means 9 may be provided on either or both sides of inlet 21 and outlet 22. The structure of the controlled seal means is not limited to the illustrated one.

It is to be noted that an extension 25 which is continuous to the inlet slit defining sleeve 28 defines the inlet slit together and also serves as a guide.

Fourth Embodiment

Figure 5:
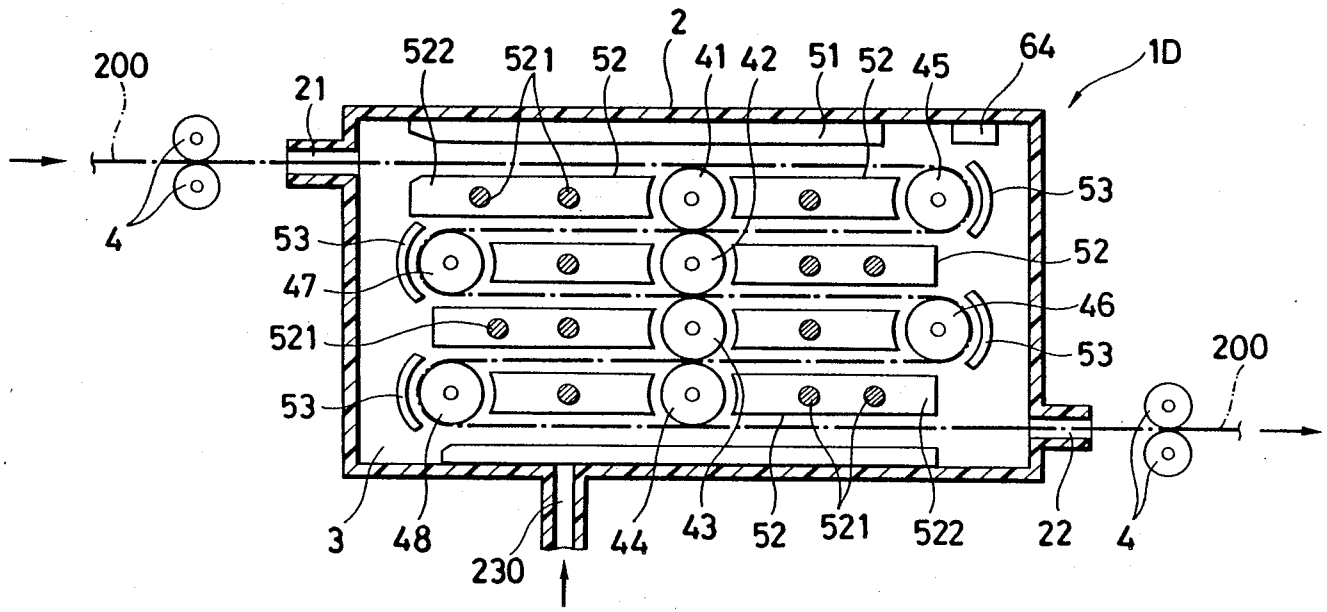

FIG. 5 is a schematic cross section of photosensitive material processing apparatus according to a fourth embodiment of the present invention.

Regarding the construction and operation of the photosensitive material processing apparatus 1D shown in FIG. 5, the following description is made of only its difference from apparatus 1A of FIG. 1. The remaining construction and operation are substantially the same as in apparatus 1A of FIG. 1.

As opposed to apparatus 1A in which the web or sheet of photosensitive material 200 is carried through processing tank 2 along a substantially linear path, the photosensitive material processing apparatus 1D of this embodiment is designed such that the web or sheet of photosensitive material 200 is turned around plural times along a serpentine path. The winding path provides a longer path for the photosensitive material than the linear path in the same volume of tank, leading to efficient processing and solution and space savings.

Approximately at the center of processing tank 2 of the closed type, four stages of conveyor rollers 41, 42, 43, and 44 are vertically juxtaposed in mutual contact. Disposed to the right of rollers 41 and 43 in FIG. 5 are conveyor rollers 45 and 46 for reversal. Disposed to the left of rollers 42 and 44 in FIG. 5 are conveyor rollers 47 and 48 for reversal. A plurality of guides including top and bottom guides 51, intermediate guides 52 and reversal guides 53 are disposed in place relative to the rollers. These rollers and guides define a winding path along which the web or sheet of photosensitive material 200 travels. The photosensitive material passes along five substantially linear path segments while making four turns at the end of each segment except the last. The overall path length is about 5 times the longitudinal distance of the tank.

The top and bottom guides 51 in the form of plates are attached to the top and bottom walls of processing tank 2.

The intermediate guides 52 each are disposed between rollers 41–48. More particularly, a plurality of rods 521 extend parallel to the axis of rollers 41–48 or transverse to the direction of movement of the photosensitive material. A plurality of transversely spaced-apart guide plates 522 are fixedly mounted on rods 521, thus forming intermediate guides 52. The intermediate guides 52 of a plow-like structure allow for free flow of the processing solution in tank 2.

The reversal guides 53 are disposed adjacent and faced to conveyor rollers 45, 46, 47 and 48 for assisting in turning the web or sheet of photosensitive material around the rollers. The guides 53 are most often in the form of curved plates having arcuate surfaces so that the photosensitive sheet may change its direction while moving along the arcuate surface.

It is seen that the photosensitive material processing apparatus 1D in the embodiment of FIG. 5 is not provided with inlet and outlet seal means as found in the previous embodiments. Of course, such seal means may also be built in apparatus 1D.

It is to be noted that the solution supply means 6 as shown in FIGS. 1 to 3 is omitted in the embodiment of FIG. 5 for brevity of illustration except that only a supply port 230 and a pressure sensor 64 are shown. The photosensitive material processing apparatus 1D in the embodiment of FIG. 5 includes such solution supply means having the same function as in the previous embodiments.

Fifth Embodiment

Figure 6:
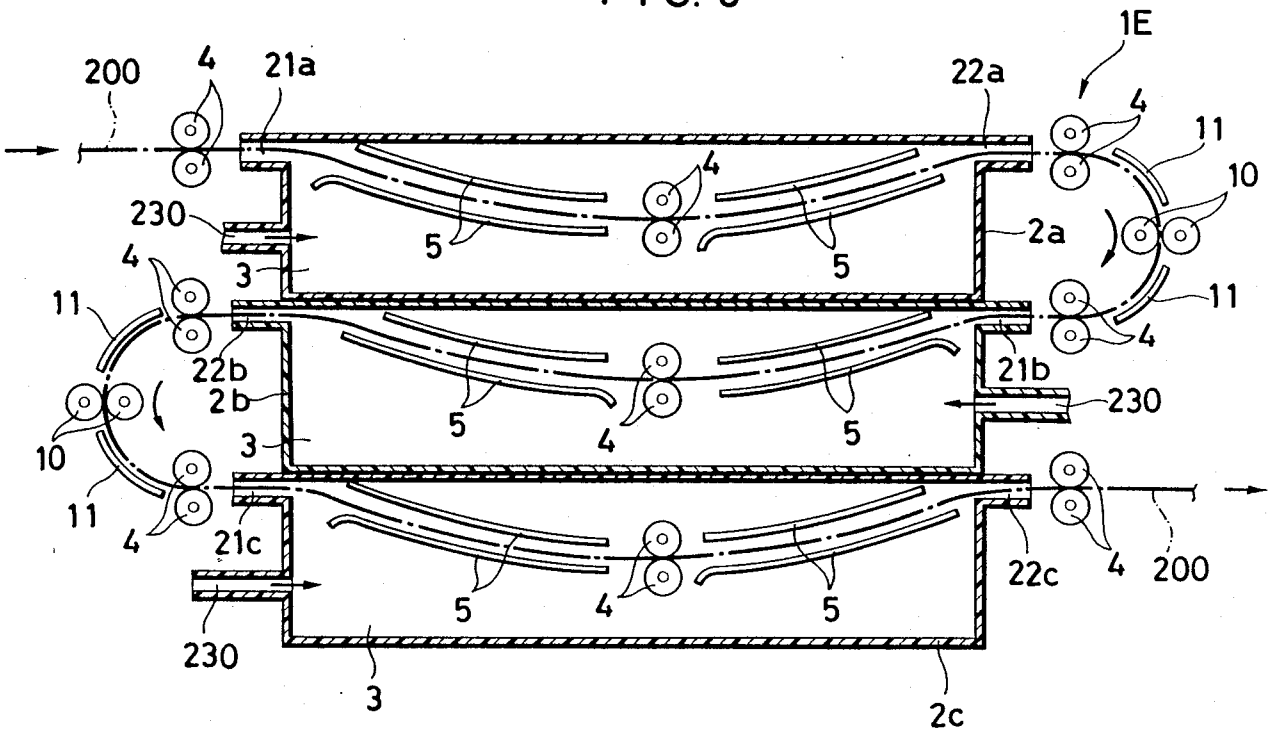

FIG. 6 is a schematic cross section of photosensitive material processing apparatus according to a fifth embodiment of the present invention.

Regarding the construction and operation of the photosensitive material processing apparatus 1E shown in FIG. 6, the following description is made of only its difference from apparatus 1A of FIG. 1. The remaining construction and operation are substantially the same as in apparatus 1A of FIG. 1.

The photosensitive material processing apparatus 1E includes vertically stacked three processing tanks **2*a*, 2*b*, and 2*c* of the closed type. The three processing tanks 2*a*, 2*b*, and 2*c* are of substantially the same structure and assigned to development, bleach-fixation, and water rinsing. A web or sheet of photosensitive material 200** is successively conveyed through the tanks while it is processed for development.

Each of three processing tanks **2*a*, 2*b*, and 2*c* has an inlet 21 and an outlet 22 at longitudinally opposite top ends. A pair of conveyor rollers 4, 4 are disposed approximately at the center of each tank and pairs of guide plates 5, 5 disposed on opposite sides of center rollers 4, 4. A pair of conveyor rollers 4, 4 are positioned in register with inlet 21 and another pair of conveyor rollers 4, 4 are in register with outlet 22**, both outside the tank. These rollers and guide plates define an arcuate path (shown in phantom) for passage of the photosensitive material through the tank.

A pair of crossover rollers 10, 10 are located between outlet **22*a* of first processing tank 2*a* and inlet 21*b* of second processing tank 2*b*, and another pair of crossover rollers 10, 10 are located between outlet 22***b* of second processing tank 2*b* and inlet 21*c* of third processing tank 2*c*. Reversal guides 11 in the form of curved plates are disposed on upper and lower sides of crossover rollers 10 for assisting in turning around the web or sheet of photosensitive material 200.

Each tank is provided with an inlet port 230 for introducing processing solution from a reservoir (not shown) for replenishment.

The photosensitive material processing apparatus 1E of the above construction operates as follows.

A web or sheet of photosensitive material 200 is delivered to the apparatus from the left in FIG. 6. The photosensitive sheet 200 is then carried as shown by arrows. It is clamped between inlet rollers 4, 4 and carried into developing tank 2*a* through inlet slit 21*a*. It is passed through tank 2*a* along the arcuate path defined between rollers 4 and guide plates 5 while it is developed.

The developed photosensitive sheet 200 is then taken out of developing tank 2*a* through outlet 22*a*, clamped between outlet rollers 4, 4, and turned around by crossover rollers 10 and reversal guide plates 11. The thus turned back photosensitive sheet 200 is clamped between inlet rollers 4, 4 and carried into bleach-fixing tank 2*b* through inlet slit 21*b*. It is passed through tank 2*b* along the arcuate path defined between rollers 4 and guide plates 5 while it is bleach-fixed.

The fixed photosensitive sheet 200 is then taken out of bleach-fixing tank 2*b* through outlet 22*b*, clamped between outlet rollers 4, 4, and turned around by crossover rollers 10 and reversal guide plates 11. The thus turned back photosensitive sheet 200 is clamped between inlet rollers 4, 4 and carried into rinsing tank 2*c* through inlet slit 21*c*. It is passed through tank 2*c* along the arcuate path defined between rollers 4 and guide plates 5 while it is rinsed with water.

The rinsed photosensitive sheet 200 is then taken out of rinsing tank 2*c* through outlet 22*b*, clamped between outlet rollers 4, 4, and delivered to a subsequent station.

It is seen that the photosensitive material processing apparatus 1E in the embodiment of FIG. 6 is not provided with inlet and outlet seal means as found in the previous embodiments. Of course, such seal means may also be built in apparatus 1E.

It is to be noted that the solution supply means 6 as shown in FIGS. 1 to 3 is omitted in the embodiment of FIG. 6 for brevity of illustration except that only inlet ports 230 are shown. The photosensitive material processing apparatus 1E in the embodiment of FIG. 6 includes such solution supply means associated with each of tanks 2*a*, 2*b*, and 2*c* having the same function as in the previous embodiments.

Only the materials of which rollers 4 and squeezers 81, 82 are formed are described. Other components may be formed by any desired materials insofar as they are resistant to and insoluble in the processing solution.

The photosensitive material processing apparatus of the present invention has many advantages. The use of a processing tank of the closed type not only prevents the processing solution from evaporating, but also retards temperature lowering, deterioration and changes of properties as by oxidation.

The processing tank of the closed type requires no particular orientation for its installation and thus imposes little limit on the setting of a photosensitive material travel path as opposed to a conventional open top processing tank which must be installed upright for preventing solution spillage. A wide range of freedom is allowed for the design of a processing tank for installation and the design of a photosensitive material travel path. There is obtained a processing apparatus of a relatively small size by virtue of a saving of the installation space for the processing tank.

When the photosensitive material processing apparatus is provided with seal means in proximity to its inlet and outlet, leakage of the processing solution is positively prohibited against external physical shocks and vibration.

Obviously many modifications and variations of the present invention are possible in the light of the above teachings. It is therefore to be understood that within the scope of the appended claims, the invention may be practiced otherwise than as specifically described.

I claim:

1. A photosensitive material processing apparatus comprising a processing tank of the closed type having an inlet slit and an outlet slit for photosensitive material, the tank being filled with processing solution and having no open space present above the surface of the processing solution, seal means disposed adjacent said inlet slit and/or said outlet slit for providing a fluid-tight seal to the slit, but allowing passage of the photosensitive material, transfer means for carrying the photosensitive material into the tank through the inlet, along a predetermined path in the tank, and then out of the tank through the outlet, and supply means for supplying processing solution to the tank wherein said supply means supplies a controlled amount of processing solution to the tank to maintain the solution in the tank at a predetermined pressure, wherein each of said inlet and said outlet is in the form of a slit having such a small opening that the processing solution may not leak through the slit due to its surface tension.

2. The apparatus of claim 1, wherein the supply means replenishes the processing solution in an amount corresponding to the drag-out of the processed photosensitive material while preventing air from entering the processing tank through the inlet slit and outlet slit.

* * * * *